US007282462B1

(12) United States Patent
Ohnstad et al.

(10) Patent No.: US 7,282,462 B1
(45) Date of Patent: Oct. 16, 2007

(54) BODY ARMOR STRAND STRUCTURE, METHOD AND PERFORMANCE

(75) Inventors: Thomas S. Ohnstad, Salem, OR (US); Michael R. Dennis, Scappoose, OR (US)

(73) Assignee: MJD Innovations, LLC, Scappoose, OR (US)

( * ) Notice: Subject to any disclaimer, the term of this patent is extended or adjusted under 35 U.S.C. 154(b) by 290 days.

(21) Appl. No.: 11/103,688

(22) Filed: Apr. 12, 2005

(51) Int. Cl.
*F41H 5/00* (2006.01)
*F41H 5/08* (2006.01)
*D03D 15/00* (2006.01)
*D02G 3/02* (2006.01)

(52) U.S. Cl. ..... 442/189; 428/397; 428/400; 89/36.01; 89/36.05; 89/36.07

(58) Field of Classification Search ..... 428/36.01, 428/36.05, 36.07, 397, 400
See application file for complete search history.

(56) References Cited

U.S. PATENT DOCUMENTS 4,707,399 A * 11/1987 Rambosek ..... 442/192
5,128,117 A * 7/1992 Olry et al. ..... 423/439
5,185,195 A * 2/1993 Harpell et al. ..... 428/102
5,738,818 A * 4/1998 Atmur et al. ..... 264/624
6,135,006 A * 10/2000 Strasser et al. ..... 89/36.05
6,679,157 B2 1/2004 Chu et al.

* cited by examiner

*Primary Examiner*—Terrel Morris
*Assistant Examiner*—Matthew D. Matzek
(74) *Attorney, Agent, or Firm*—Jon M. Dickinson, PC; Robert D. Varitz, PC

(57) ABSTRACT

Structure, methodology and performance involving and utilizing body armor strand material which includes an elongate strand body possessing elongate brittle ceramic surface structure, elongate ductile core structure disposed within that surface structure, and elongate brittle/ductile transition structure operatively interposed and joining the surface and core structures. Methodology includes the steps of preparing a defined mass of elongate ceramic-surfaced, ductile-cored strand elements, each including, along the outside of its length, elongate, sharp-angular edges, and placing that mass in the impact path of such a projectile in a manner whereby edges in the strands face the projectile impact path. Response performance of the invented strand material includes using fragmentation of a surface-hardened ceramic therein to dissipate energy, cutting an impacting projectile into fragments and deflecting those fragments, and telegraphing fragmentation of the ceramic material through a brittle/ductile region in the strand material to a ductile core-region wherein resulting deformation of this core region further dissipates projectile energy.

5 Claims, 2 Drawing Sheets

BODY ARMOR STRAND STRUCTURE, METHOD AND PERFORMANCE

BACKGROUND AND SUMMARY OF THE INVENTION

This invention pertains to strand-style body armor (body armor strand material, or structure), to the methods for it making, and to the armoring performance offered by the proposed structure.

There is a pronounced effort currently underway to develop extremely light-weight body armor which can defeat dangerous projectiles, such as bullets. The present invention addresses this issue in a quite effective and non-intuitive manner by proposing that body armor be formed by extremely light-weight elongate strand structure, formed by elongate, slender strands which, effectively, are made of a unique "ductile ceramic" material, preferably based upon titanium. These strands include brittle ceramic outside surface structure which joins through a continuous, internal, brittle/ductile transition region to a central, ductile core region. Various transverse cross-sectional configurations may be employed, each of which preferably defines plural elongate, sharp-angle edges that run the length of each strand. Several of these configurations are illustrated and described herein.

As will be seen, the proposed armor strands may be assembled for "presentation" to the path of an oncoming projectile in various ways. Two such ways are shown and described herein, one of which involves a weave of strands, and the other of which involves a fabric-contained random and chaotic jumble of short, freely mixed "strandlets".

The strands of this invention respond to an impacting projectile: (a) by first cutting the projectile into pieces as a consequence of projectile engagement with the sharp ceramic edges extending along the outside lengths of the strands; (b) by then undergoing ceramic fragmentation to dissipate projectile energy; and (c) by telegraphing such ceramic fragmentation through the above-mentioned brittle/ductile transition regions to the ductile cores of the strands which then deform elastically to produce further energy dissipation.

Various other features and advantages of the invention will become more fully apparent as the detailed description below is read in conjunction with the drawings.

DETAILED DESCRIPTION OF THE INVENTION

Figure 1:
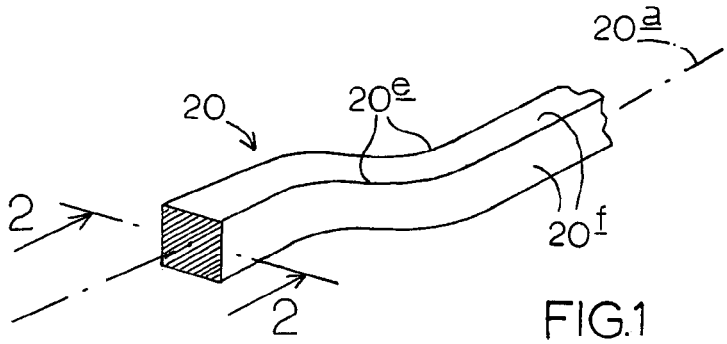
FIG. 1 is an isometric view of a fragment of a somewhat sinuous, square-cross-section armor strand made in accordance with the invention.
Figure 2:
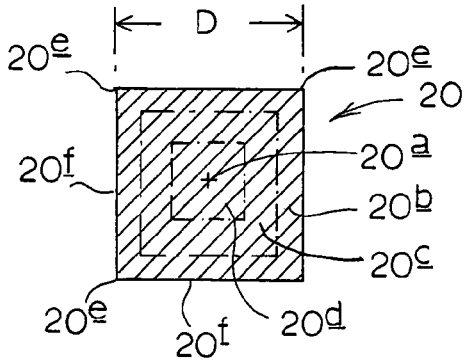
FIG. 2 is an enlarged transverse cross section of the strand shown in FIG. 1, taken generally along the line 2-2 in FIG. 1.

Turning now to the drawings, and beginning with a look at FIGS. 1 and 2, indicated generally at 20 is a fragment of an elongate armor strand, or strand body, which has been made, and which performs, in accordance with a preferred and best mode embodiment of, and manner of practicing, the present invention. Strand 20 has a long axis 20*a*, and a square-perimeter cross section, with a transverse side-length dimension D in the range of about ⅛- to about ¼-inches.

Strand 20 has been made by extrusion preferably from a titanium starter, or precursor, material known as Tiadyne™3510, made by ATI Wah Chang in Albany, Oreg. This principally titanium material is ductile in character, and can be prepared into different shapes and configurations by various conventional manufacturing techniques, such as casting, machining, extruding, etc. In FIG. 1, strand fragment 20 is shown with a curving, sinuous wave in it to illustrate the fact of its basic flexibility and ductility.

In accordance with the invention, however, strand 20 has been further processed, as by baking in an oven at a temperature of about 1700° F. and in an oxidizing atmosphere, or environment, for a time range typically of about 5 minutes to about 1 hour, at user's selection, depending upon the depth of surface processing desired, to create what is referred to as a brittle, ceramic surface structure 20*b* of titanium dioxide. Creation of this surface structure produces an important internal structure within the strand, characterized by "blending" non-discontinuously of surface structure 20*b*, through an intermediary brittle/ductile transition region, or structure, 20*c*, to a central, ductile core structure 20*d* which contains axis 20*a*.

Important to note in the structure of strand 20 is that its outside surface includes plural, sharp-angular, elongate edges 20*e* defined by the intersection of pairs of faces, or facial expanses, 20*f* which, in the strand structure illustrated in FIGS. 1 and 2, intersect at angles of about 90°. In all versions, or modifications, of armor strand structure made in accordance with the present invention, it is preferable that, though not absolutely necessary, all such edges be defined by surface-intersection angles which are no greater that about 90°. Where all strand edges do not meet this criterion, and one version of the strand structure of this invention is illustrated and described herein in this status (see FIG. 6), it is important that some strand edges do meet this criterion. Such is true for the just briefly mentioned FIG. 6 modification of the invention.

Turning attention now to FIGS. 3-8, inclusive, here, six alternative embodiments of the armor strand structure of the present invention are shown in transverse cross section. All have been processed to create the same-character internal structure described above for strand 20.

Figure 3:
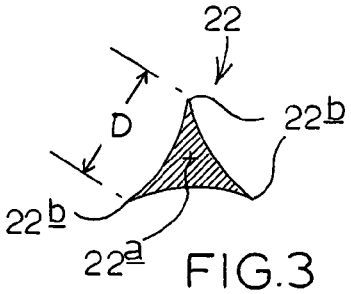
FIGS. 3-8, inclusive, illustrate strand structures each having a different cross-sectional configuration which is also different from the transverse cross section of the strand pictured in FIGS. 1 and 2.

FIG. 3 illustrates a strand 22 having a long axis 22*a*, and a generally concavely-sided, triangular, transverse cross section with three sharp edges 22*b*. Dimension D here lies typically in the range of about ⅛- to about ¼-inches.

Figure 4:
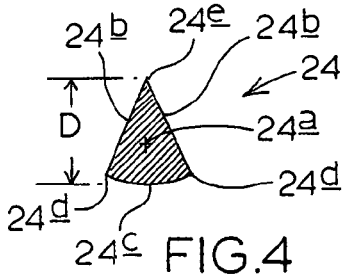

FIG. 4 shows a strand, or strand body, 24 having a long axis 24*a*, two planar sides 24*b*, and a conversely curved, third side 24*c*. This strand includes three sharp edges, including two which are shown at 24*d* that are defined by an angle which is somewhat greater than that which defines the third edge 24*e*. Dimension D here is typically the same as that mentioned above for strands 20, 22.

Figure 5:
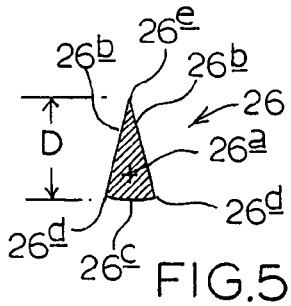

FIG. 5 pictures a strand 26 which is, essentially, a "slender" version of strand 24. The reference-number/character labeling here is like that used in FIG. 4 for strand 24. Dimension D is the same also.

Figure 6:
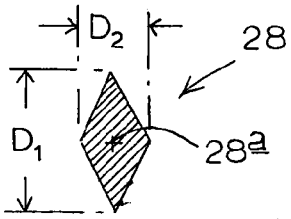

FIG. 6 shows a strand 28 which has a diamond-shaped transverse cross section, and a long axis 28*a*. The unlabeled four edges in this strand exhibit two different sharpnesses, as shown, with the upper and lower edges in the figure being defined each by an angle which is less than 90°, and the two "lateral" edges being defined by an angle which is slightly greater than 90°.

Figure 7:
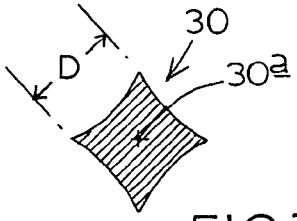

FIG. 7 shows a strand 30 having a long axis 30*a*. Strand 30 is, essentially, a concavely-sided version of previously described strand 20.

Figure 8:
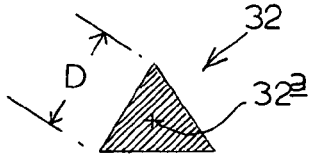

FIG. 8 pictures a strand 32 which has a long axis 32*a*, and which is effectively, a planar-sided version of previously described strand 22.

Figure 9:
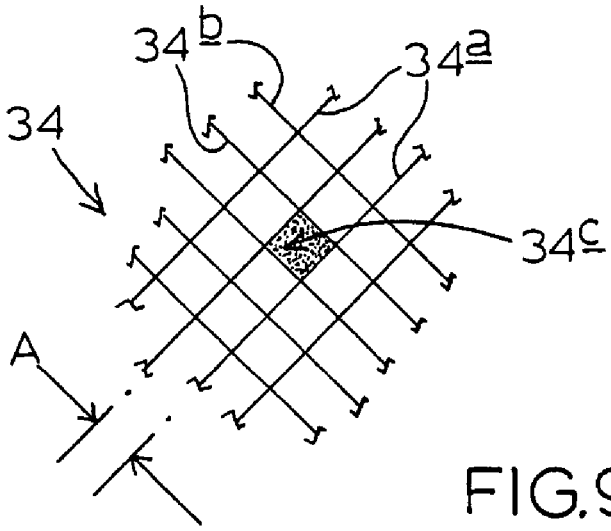
FIG. 9 provides a simplified and fragmentary view of a woven fabric, also called herein a weave, formed by strands like the strand pictured in FIGS. 1 and 2.

With attention now directed to FIG. 9 along with FIGS. 1-8, inclusive, here there is shown at 34 a fragment of a woven, protective-armor fabric, or fabric weave, which has been made from sets 34*a*, 34*b*, of angularly "crossing" armor strands, or strand bodies, drawn from any one (or a mix) of the various armor strand versions previously described and illustrated herein. Preferably, the strands employed in fabric 34 are woven in such a fashion that, predominately, at least one of the broad "faces" of this fabric (such as the one facing the viewer in FIG. 9) is defined chiefly by sharp edges in the associated strands. A second consideration for the construction of fabric 34 is that the open spaces, such as space 34*c* in the fabric, be dimensioned (A) so that the sharp edges in the four armor strands which define this space are close enough together to be certain to engage the smallest-size impacting projectile (such as a bullet) which is anticipated may strike the fabric. Multiple layers of woven fabric may, of course, be used for protection, if desired.

With a fabric like fabric 34 properly created to produce what is referred to herein as a mass of elongate armor strand elements, and with its broad impact face and the associated sharp edges of stands 34*a*, 34*b*, facing the path of an incoming attack projectile, upon impact of that projectile the brittle, ceramic, sharp edges cut the projectile into pieces, with these pieces engaging and plastically fragmenting the outside surfaces of many adjacent strands. This ceramic fragmentation acts instantly to dissipate the energies of the now cut projectile pieces, and fragmentation events are telegraphed through the associated brittle/ductile transition regions in the involved strands, where what next occurs is non-fragmentary ductile yielding, and thus further energy dissipating furnished by the associated ductile strand core regions.

Thus, instead of a projectile being met by a single (one-time only) fragmentable energy dissipating structure, that projectile is divided by cutting it into many pieces, whose individual trajectories aim them for impact to a rich field of yet unfragmented, and thus available hardened ceramic fragmentation surfaces, additional cutting edges, and additional ductile yield responses. This is especially the case where fully assembled protective armor is formed of plural "stacked" fabric layers.

Figure 10:
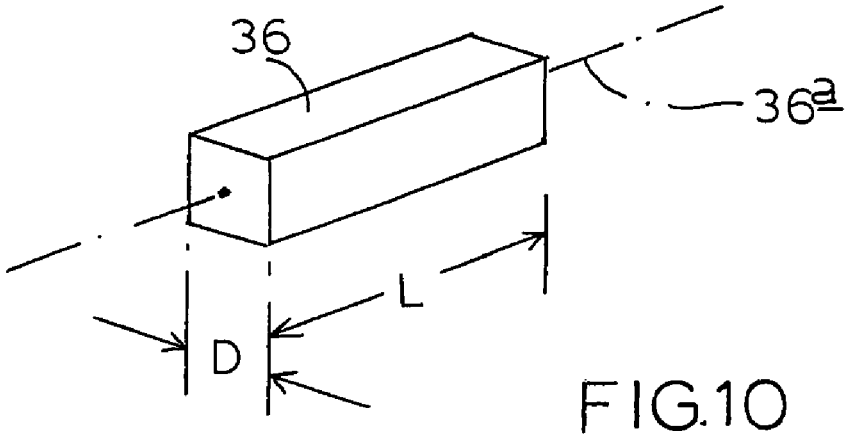
FIG. 10 is a view of what was referred to above as a "strandlet" which is somewhat like the strand structure shown in FIGS. 1 and 2.
Figure 11:
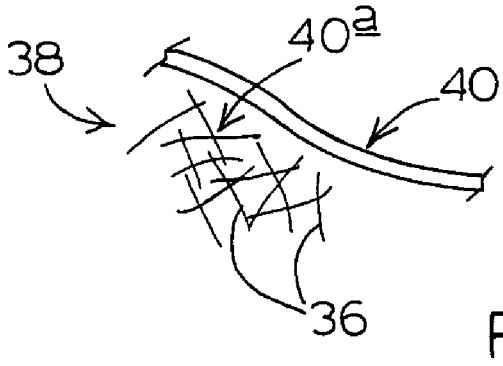
FIG. 11 is a simplified view of a fragment of a prepared, jumbled mass of randomly and chaotically assembled (and appropriately contained) strandlets like the one illustrated in FIG. 10.

FIGS. 10 and 11 collectively illustrate the structure and use of yet another implementation of the present invention. Shown at 36 in FIG. 10 is a short-length armor strand which is, other than for length L, substantially the same as earlier discussed strand 20. Short strand 36, referred to herein as a strandlet, has a long axis 36*a*, and a square-perimeter cross section with a transverse side length D which resides typically in the same dimensional range mentioned above for strand 20. Preferably, dimension L lies in the range of about 2- to 8-times dimension D. Thus, where D≈⅛-inches, L≈about ¼-inches to about 1-inch. In FIG. 10, D=⅛-inches and L=1-inch.

Strandlet 36 has been processed as described for strand 20 so that it has a brittle, ceramic, four-cornered outside surface which joins through a brittle/ductile transition region to a ductile core region adjacent axis 36*a*.

When assembled into a fully ready body armor structure, a large mass of strandlets 36 are appropriately gathered into what is referred to herein as a random, chaotic jumble, such as that shown at 38 in FIG. 11. Preferably, strandlets 36 in mass 38 are contained in a fabric, or fabric container structure, 40 which is made to be like above-discussed fabric 34. Specifically, mass 38 is contained within what is referred to herein as a fillable reception zone 40*a* within fabric 40. Such an arrangement produces a formidable barrier to an attacking projectile. Inpacting projectiles are cut into many pieces instantly upon impact. These pieces engage a dense thicket of "ready and available" ceramic fragmentation surfaces, each of which presents additional hardened cutting edges and fragmentation surfaces, all backed up, so-to-speak, by ductile response cores in the actively engaged strandlets.

Thus, disclosed herein are a novel strand-form body armor material, a method for making it, a method utilizing it to disable an impacting projectile, and a unique response-performance provided by it for defeating an impacting projectile.

The strand material of the invention includes (a) a strand body possessing an elongate brittle ceramic surface structure, (b) an elongate ductile core structure disposed within that surface structure, and (c) elongate brittle/ductile transition structure operatively interposed and joining the surface and core structures. This strand material may be employed, for examples, as a random mass of short strandlets deployed in a suitable container, and as a woven fabric structure formed from long stretches of the strand material.

The method utilizing the strand material for disabling an impacting projectile includes the steps of preparing a defined mass of elongate ceramic-surfaced, ductile-cored strand elements, each including, along the outside of its length, elongate, sharp-angular edges, and placing that mass in the impact path of such a projectile in a manner whereby edges in the strands face the projectile impact path.

The response performance of the strand material includes using fragmentation of the surface-hardened ceramic material to dissipate energy, cutting an impacting projectile into fragments and deflecting those fragments, and telegraphing fragmentation of the ceramic material through a brittle/ductile region in the strand material to a ductile core-region wherein resulting deformation of this core region further dissipates projectile energy, From the description and illustrations provided herein, those skilled in the relevant art will recognize, that variations and modifications may be made without departing from the spirit of the invention, and all such variations and modifications are intended to come within the scopes of the claims herein.

We claim:

1. Homogeneous, ceramic body armor strand material comprising an elongate, homogeneous strand body having a long axis and including elongate brittle ceramic surface structure extending around and surrounding said long axis, elongate ductile core structure disposed within said surface structure and containing said long axis, and elongate brittle/ductile transition structure operatively interposed and joining said surface and core structures as a material continuum therewith.

2. Homogeneous, ceramic body armor strand-material fabric comprising a weave of elongate strand bodies having respective long axes, with each body including a brittle ceramic surface structure extending around and surrounding its said long axis, ductile core structure disposed within said surface structure and containing said long axis, and brittle/ductile transition structure operatively interposed and joining said surface and core structures as a material continuum therewith.

3. Homogeneous, ceramic body armor structure comprising a woven fabric container structure including a fillable reception zone, and disposed within said zone, at least a partial fill of randomly and chaotically received and disposed elongate strand bodies having respective long axes, with each body including (a) elongate brittle ceramic outside surface structure extending around and surrounding its said long axis, (b) elongate ductile core structure disposed within said surface structure and containing said long axis, and (c) elongate brittle/ductile transition structure operatively interposed and joining said surface and core structures as a material continuum therewith.

4. Body armor strand material comprising an elongate strand body having a long axis and including elongate brittle ceramic surface structure possessing elongate, sharp-angular edges extending along the outside thereof generally parallel to said long axis, elongate ductile core structure disposed within said surface structure, and elongate brittle/ductile transition structure operatively interposed and joining said surface and core structures.

5. The material of claim 4, wherein said edges, when viewed in a plane which is substantially normal to said long axis, are seen to be formed by pairs of intersecting facial expanses existing on the outside of said surface structure, which facial expanses intersect preferably at no more than about a 90° angle.

* * * * *